US005392474A

United States Patent [19]

Schmidt

[11] Patent Number: 5,392,474

[45] Date of Patent: Feb. 28, 1995

[54] BATHTUB-INSERTABLE LIFTING APPARATUS

[75] Inventor: Peter Schmidt, Eisenberg, Germany

[73] Assignee: Schmidt & Lenhardt GmbH & Co. OHG, Isny, Germany

[21] Appl. No.: 199,384

[22] Filed: Feb. 18, 1994

[30] Foreign Application Priority Data

Mar. 5, 1993 [EP] European Pat. Off. ..... 93103521

[51] Int. Cl.[6] ..... A47K 3/12

[52] U.S. Cl. ..... 4/566.1

[58] Field of Search ..... 4/560.1-566.1

[56] References Cited

U.S. PATENT DOCUMENTS 3,419,044 12/1968 Daniels et al. ..... 4/566.1 X 3,545,013 12/1970 Discoe ..... 4/563.1

*Primary Examiner*—Charles E. Phillips

*Attorney, Agent, or Firm*—Notaro & Michalos

[57] ABSTRACT

The lift platform (16) of a lifting apparatus (10) can be raised and lowered by means of an hydraulically operated lifting device (12). The back rest (18) can be swivelled backwards and forwards by a swivelling means (19), which is likewise hydraulically operated. Both working devices (12, 19) are connected to a multi-valve housing (20), which is located beneath the lift platform (16) and which has no manual control means at all. The valves are triggered hydraulically by remote control. For this purpose, a manual control unit (30) with a number of built-in servo valves is connected to the multi-valve housing (20) via a flexible cable (28), which contains a number of thin control hoses and an hydraulic water supply hose.

11 Claims, 5 Drawing Sheets

BATHTUB-INSERTABLE LIFTING APPARATUS

BACKGROUND OF THE INVENTION

The invention relates to a lifting apparatus for handicapped persons useful for insertion in a bathtub, comprising a bottom frame, a lift platform, a guide frame connecting the lift platform to the bottom frame, and an hydraulic lifting device with valve means.

PRIOR ART

A lifting apparatus of this kind is known from EP-C-0347652, in which a manually operated valve is mounted beneath the lift platform, with the operating lever passing through a slot in the lift platform and protruding upwards over the seat of the lift platform. The valve means is attached to an hydraulic water supply line by means of a hose and, when the control lever is in one swivelled position, connects the lifting device to the hydraulic water supply, so that the lift platform travels upwards; when the control lever is in the other swivelled position, it connects the lifting device to a discharge line, so that the lift platform travels downwards. When the manual lever is in a central position, the lift platform remains in its present position.

The manual operating lever must be easy to reach both for the handicapped person sitting on the lift platform and for helpers outside the bathtub. For this reason, in the known lifting apparatus, the lever is positioned close to the lateral edge of the lift platform, approximately in the region where the thighs rest. Since many bathtubs are built in beside one of the bathroom walls, the manual operating lever ought to be located on the side of the lifting apparatus next to the bathroom wall, because the lever would otherwise be in the way when the handicapped person climbed into or out of the bath. For this reason, there are left and right-hand versions for the way in which the bathtub is fitted in each case. Hospitals, however, do not have a separate lifting apparatus available for each bathtub, so that it is unavoidable that, in many cases, the operating lever will also be on the side where people climb in or out.

In order to overcome these shortcomings, lifting apparatuses are known in which the manual operating element has two buttons protruding only slightly above the lift platform. This solution has other disadvantages in that many handicapped persons have difficulty finding and selecting the correct button underwater.

SUMMARY OF THE INVENTION

The object of the invention is to improve a lifting apparatus of the type described at the beginning with regard to the control system for the hydraulic drives in such a way that operation is facilitated both for a handicapped person and for the helper.

This problem is solved according to the invention in that the valve means, including its operating means, is located completely beneath the bottom plane of the lift platform and comprises a number of remotely operable working valves; a manual control unit is connected to the valve means via a plurality of flexible hoses; the manual control unit comprises a number of manually operable servo valves of substantially identical design with, in each case, a control chamber on one side of a valve seat and one of the hoses terminating in said chamber; a pressure chamber is formed in each servo valve on the other side of the valve seat; the pressure chambers of all the servo valves are connected to a common hose of the plurality of hoses; all the servo valves are hydraulically and/or mechanically biased in the closed position; the control chamber of each servo valve is connected, in its closed position, to a discharge line; and each servo valve has a manually operable actuator which can be moved from an initial position, against the effect of a restoring force, into one or more working positions, in which the pressure chamber communicates with the control chamber, while the latter is sealed towards the discharge line.

The invention firstly provides the advantage that there are no manual control means on the lift platform at all, so that it is possible to mount or alight from the lift platform without hindrance. Furthermore, the manual control unit can be positioned anywhere. Depending on the nature of his disability, the handicapped person can hold the control unit in his hand, lay it on his lap, hang it up on the bathroom wall in a position where it is easy to reach, or simply place it beside him on the lift platform. Helpers can operate the lifting apparatus with the manual control unit more easily and quickly, and when the lift platform is in its lowered position, they do not need to fumble about underwater for the actuator member.

Thanks to the division of the valve means into a working-valve block or a number of separate working valves beneath the lift platform, on the one hand, and the hydraulic control unit, on the other, a further development of the lifting apparatus with a plurality of hydraulic operating devices is facilitated. Thus, one embodiment of the invention consists in having pivotably disposed on the lift platform a back rest with which an hydraulic swivelling means engages, and in having the valve means possess at least four working valves and the manual control unit possess the same number of servo valves. Since experience has shown that it is quite difficult for a helper to raise from a supine position the upper part of the body of a handicapped person sitting on the lowered lift platform—because the back rest lock must first be released and swivelled forwards with the upper part of the body and then locked again—, this embodiment offers a solution, and the swivelling means for the back rest is controlled with the same control unit as for raising and lowering the lift platform. The manual control unit is small in size, so that it can be held in one hand. The hydraulic connection lines do not impair this handiness, since they require an outer diameter of only four millimeters or less, because small quantities of water are sufficient to trigger the working valves. The at least five hoses to operate four working valves are preferably surrounded by a spiral hose, which hardly needs to be any thicker than a standard shower hose.

The manual control unit can have a separate operating element, such as a push-button for example, for each servo valve. It is, however, preferable to provide a common operating element for all the servo valves, e.g. in the form of a joy-stick, or in other words a lever that can be moved in a plurality of planes at angles to one another. Preferably, a gate is proposed for this purpose so that the central lever can be directed precisely. In this connection, it is also within the scope of the invention to manage without a gate, in which case the central lever can then be swivelled in all directions, with the possibility of having the central lever in a diagonal position, with the effect of raising the lift platform and swivelling the back rest forwards simultaneously. The thin control lines each terminate in a control chamber of a servo valve. An important point now is that this control chamber must be permanently connected either to the pressure supply line or to the discharge line. As long as no hydraulic device on the lifting apparatus is in operation, all the servo valves are in the closed position and the associated control hoses are connected to the discharge line or, in each case, to a drain hole on the control unit. The control lines are then free of pressure. Similarly, the working valves in the valve block beneath the lift platform are likewise closed. When the manual operating element on the control unit is then operated, at least one servo valve is moved to the open position. In this case, the control chamber is first sealed off from the discharge line before being allowed to communicate with the hydraulic water supply line. When the operating element is released, it, an actuator and the closing element are returned by means of spring resistance, and the pressure in the control hoses is released, so that the hydraulic water can flow out of the respective working valve of the valve block, which closes because of its built-in spring.

According to one embodiment of the invention, the four servo valves in the manual control unit are arranged with parallel axes, and their axes intersect the corners of a square. The manual operating element has a bearing part in the shape of a universal ball joint, which is mounted on complementary spherical surfaces of the manual control unit housing and is pivotable in at least two mutually perpendicular planes, such that the lift platform is raised and lowered in one swivelling plane and the back rest is moved backwards or forwards in the other plane. This bearing part has either a circumferentially closed outer flange or at least four radial arms distributed about the circumference. In the neutral position of the manual operating element, the faces of the four spring-operated actuating members press against said outer flange or, where applicable, said four radial arms, so that the operating element is kept in its central position.

BRIEF DESCRIPTION OF THE DRAWINGS

The invention will now be described in more detail with reference to the drawing, which shows one embodiment.

DETAILED DESCRIPTION

Figure 1:
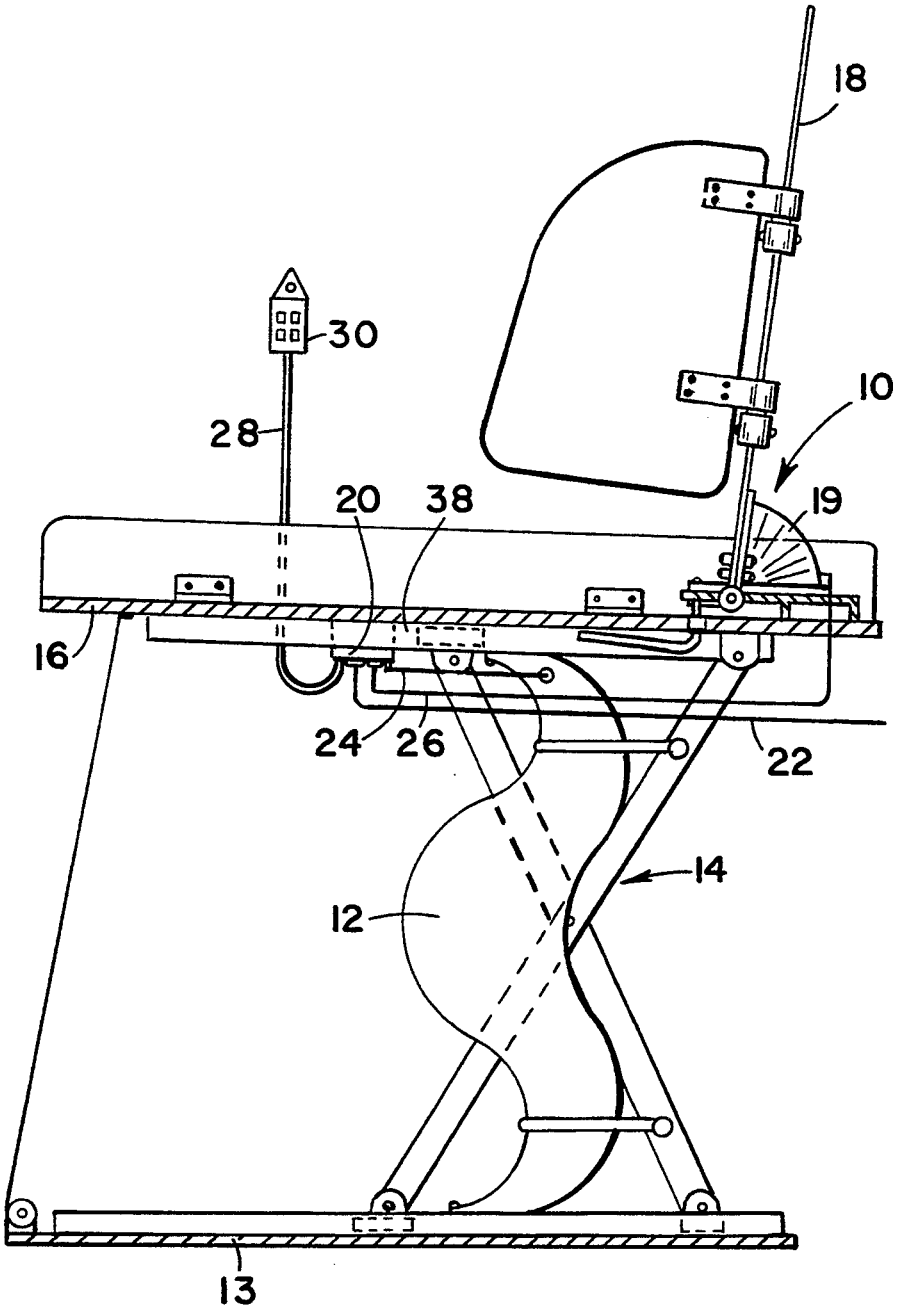
FIG. 1 is a schematic side view of a lifting apparatus with hydraulic operating means and a manual control unit.

A lifting apparatus 10 useful for insertion in a bathtub consists of a bottom mount or frame 13, with a guide frame 14 shaped like scissor arms disposed thereon and supporting a lift platform 16, a lifting device 12 in the form of a pressure-tight hose, closed at the end, being disposed between said lift platform 16 and said bottom frame 13. A back rest 18 is releasably mounted on the lift platform 16 by means of a swivel armature. An hydraulic swivelling means 19 serves to adjust the angle of said back rest 18.

Attached to the underside of the lift platform 16 there is a multi-valve housing 20 with an hydraulic water supply line 22, a connecting hose 24 leading to the lifting hose 12, a connecting hose 26 leading to the swivelling means 19, and a spiral cable 28 terminating there, and with a manual control unit 30 disposed at the end of said spiral cable 28. The multi-valve housing 20 contains four working valves, which are triggered hydraulically. There is therefore no need for manual operating elements on the multi-valve housing 20. The lift platform 16 does not require any holes to be punched through in the region of the multi-valve housing 20.

Figure 3:
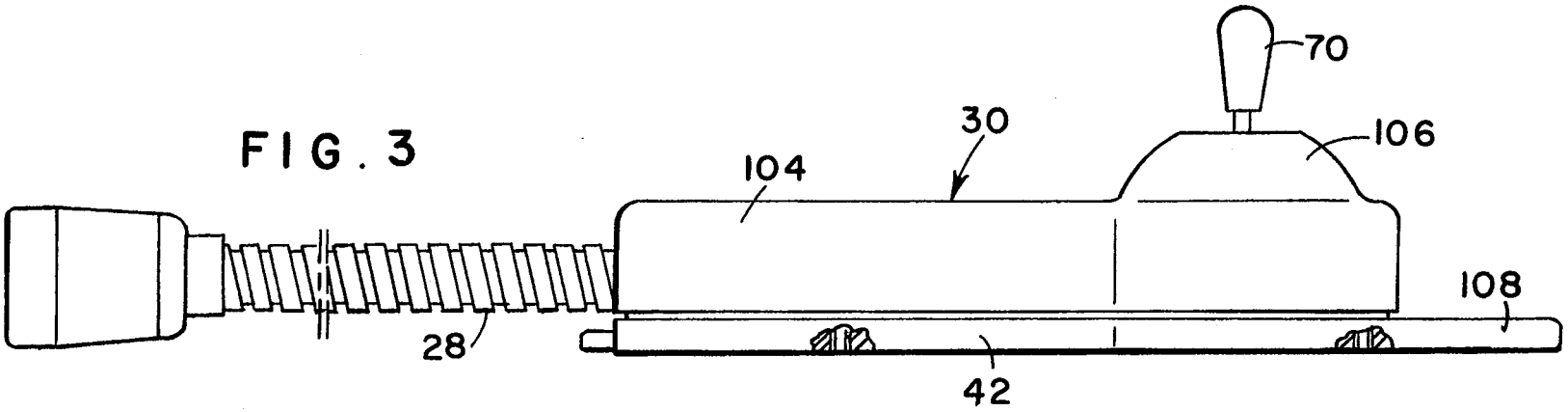
FIG. 3 is a side view of the manual control unit.
Figure 2:
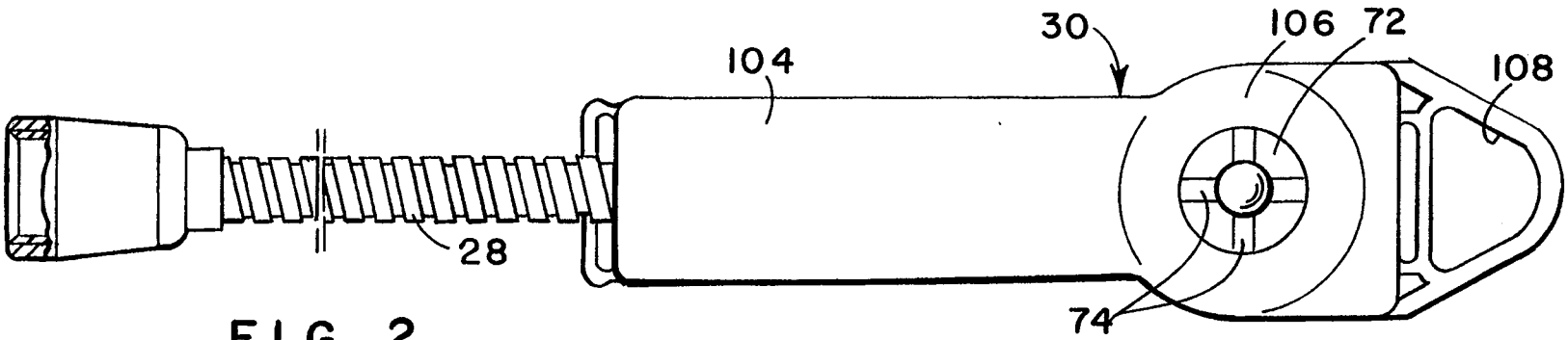
FIG. 2 is a top view of the manual control unit.
Figure 4:
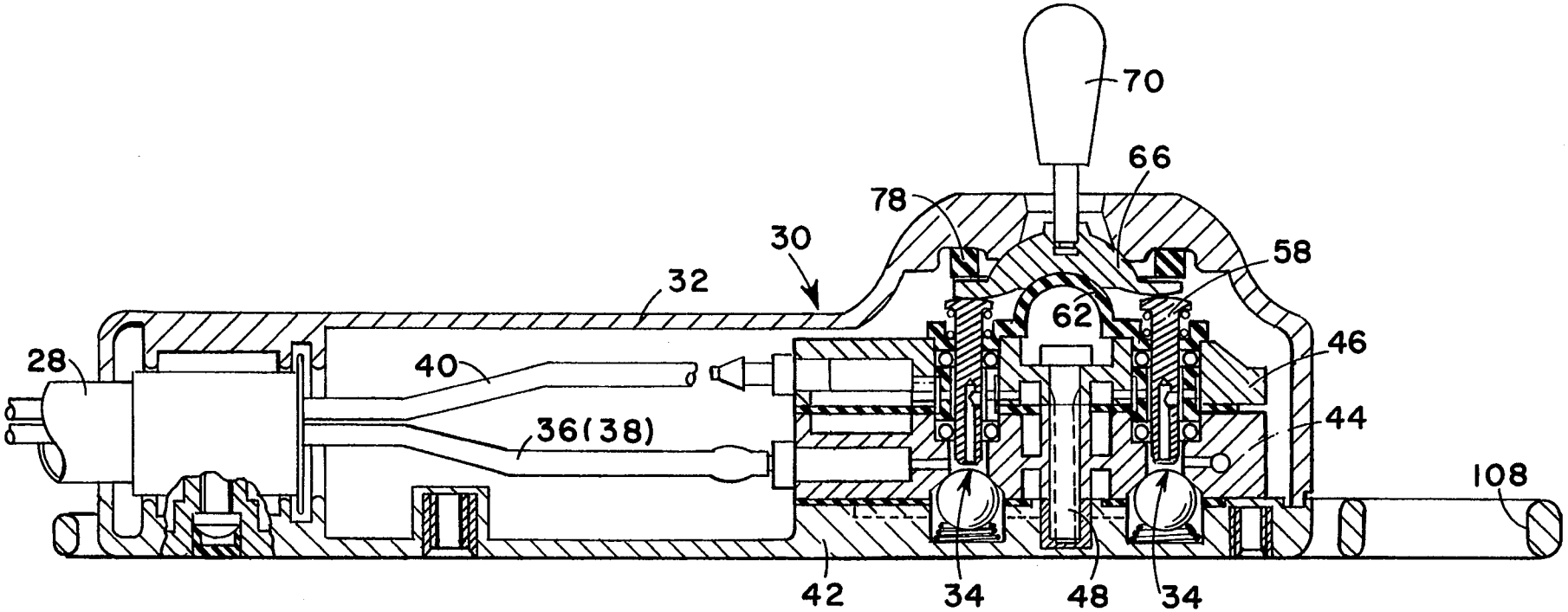
FIG. 4 is a longitudinal sectional view through the manual control unit.

The manual control unit 30 consists of a two-part housing 32 in which there is a servo valve system with four servo valves 34 whose axes are perpendicular to the floor of the housing 32 and intersect the corners of a square. The spiral cable 28 contains six thin hoses, viz. four control hoses 36, an hydraulic water supply line 38 and a discharge hose 40. The six hoses are surrounded by the spiral cable 28, which is approx. 1.5 meters long. The discharge hose 40 could be dispensed with, in which case the voids formed between the outer surfaces of the hoses 36, 38 and the inner surface of the spiral cable 28 take care of the return flow of the water to the multi-valve housing 20. At the end with the lifting apparatus, the spiral cable has a rotatable screwed-gland joint in which a coupling unit is inserted, to which the six lines are connected, each to one hole. On the multi-valve housing 20 there is a complementary counter-coupling part into which the coupling insert of the spiral cable 28 can be plugged. The screw-on sleeve is then screwed on to its counterpart, and the six lines 36, 38, 40 of the cable 28 are connected pressure-tight to a corresponding channel system in the multi-valve housing 20. The four control hoses 36 each lead to one of the four working valves in the multi-valve housing. FIGS. 2 and 3 show the manual control unit 30 in actual size.

Figure 6:
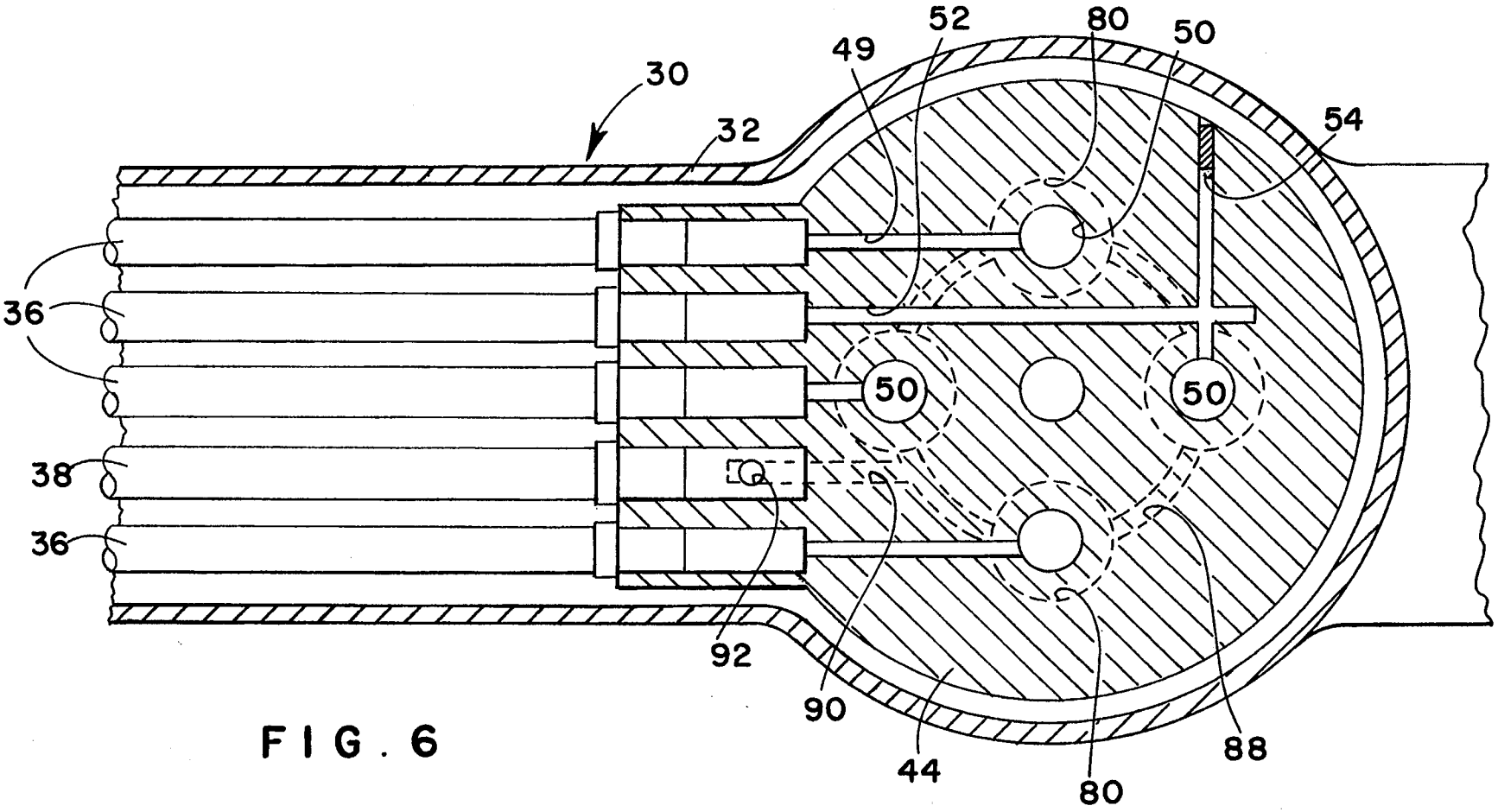
FIG. 6 is a cross-sectional view along the line 6—6 in FIG. 5.

The servo valve system in the manual control unit 30 comprises a bottom plate 42, which is part of the lower portion of the housing, and, in addition, a central plate 44 and a cover plate 46. The three plates 42–46 are bolted together by means of a bolt 48, with washers between them. The four control hoses 36 and the hydraulic water supply line 38 terminate side by side in a row (FIG. 6), at the same height, in the central plate. Three coaxial longitudinal holes 49 of the hoses 36 terminate directly in cylinder chambers 50 of the servo valves 34. The fourth longitudinal hole 52 is connected via a transverse channel 54 to the cylinder hole 50 of the fourth control hose 36. In each cylinder hole 50, there is an insert sleeve 56 with a cylindrical actuator 58 possessing radial play disposed therein. At both end faces of the insert sleeves 56 there are O-ring seals 60, which seal the actuator 58 towards the valve housing and the insert sleeves. A central housing head 62 has four pot-like indentations which engage in the cylindrical holes 50 and in turn guide the actuators 58. In the central portion, the housing head 62 has a hemispherical bearing surface 64 for a bearing plate 66 with a circular outline, which is designed in the central portion with a counter-surface 68 in the shape of a universal ball joint. The bearing plate 66 supports an operating lever 70, which is vertical when the bearing plate 66 is in a horizontal position and which passes through a gate insert 72 and protrudes upwardly out of the housing. The gate insert 72 has two mutually crossing guide slots 74, which restrict the freedom of movement of the lever 70 to the longitudinal and transverse planes.

The four actuators 58 are each pressed upwards by a spring 76 so that they are resting against the bearing plate 66, which is thus kept in the horizontal position. A compressible ring on the top side stabilises this position.

Figure 5:
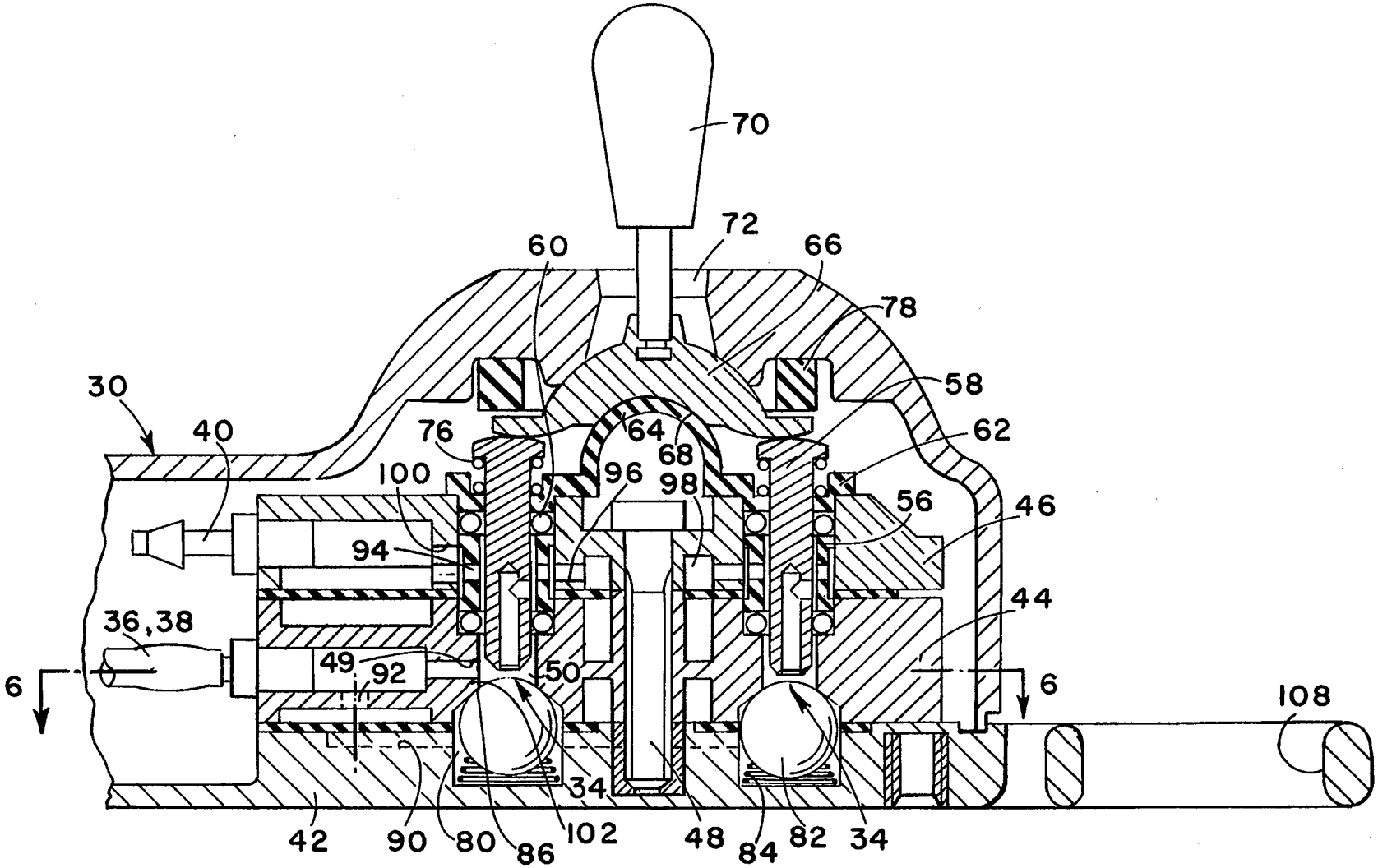
FIG. 5 is a larger-scale longitudinal sectional view through the manual control unit in the region of a servo valve device.

In a coaxial extension of the cylindrical holes 50, chambers 80 with an enlarged diameter are formed between the bottom plate 42 and the central plate 44, in which there are spherical valve bodies 82 which are pressed against a valve seat 86 by means of springs 84. The bottom plate 42 has a circumferential groove 88 which connects the chambers together and which, for its part, has a longitudinal groove 90 terminating therein (FIG. 6), which communicates with the hydraulic water supply line 38 via a vertical hole 92. The pressure chambers 80 are thus constantly filled with hydraulic water. As can best be seen from FIG. 5, the actuators 58 have axial holes which terminate at the bottom face. Said axial holes are connected via radial holes to the annular gap between the actuator 58 and the insert sleeve 56, and these annular spaces communicate with the annular chamber 98 formed in the housing cover plate 46 via at least one radial hole 94 in the insert sleeve 56 and four radial holes 96 in said cover plate 46.

The discharge line 40 is introduced into the servo valve housing in the region of the cover plate 46 and is connected to the discharge channel system via an axial hole 100. This means that, in the neutral position of the manual lever 70, the control chambers 102 above the valve seat 86 are pressure-free, since they communicate permanently with the discharge channel system, which, for its part, connects the discharge line 40 to the multi-valve housing 20. In the interior of the multi-valve housing 20, said discharge line is guided to a mouth in the housing, so that this line can constantly discharge into the bathtub.

When the lever 70 of the manual control unit 30 is swivelled into one of the four directions, the associated actuator 58 moves downwards against the effect of the reset spring 76, coming to rest against the valve body 82 and sealing off the control chamber 102 against the discharge line 40. The actuator 58 then raises the valve body 82 off the valve seat 86, so that the associated control hose 36 is connected to the pressure chamber 80. Via said control hose 36, hydraulic water flows to the connected working valve in the multi-valve housing 20, whereupon said valve opens temporarily and operates one of the two hydraulic devices 12 or 19. Said working valve remains open as long as the manual control lever 70 on the manual control unit 30 is kept in its swivelled position. When the lever 70 is released, the spring 76 of the operated actuator 58 provides for the actuator to be returned, which causes the sealing body 82 to seal off the associated control hose 36 from the hydraulic water supply and simultaneously to connect it to the discharge line 40. The hydraulic water which has entered the working valve in the multi-valve housing 20 is thus forced back into the manual control unit 30 via the control line 36, which is effected by a mechanical spring in the working valve. The water forced back then returns to the multi-path housing 20 via the discharge line 40, and drains from there into the bathtub. The working valve thus closes. The manual control lever 70 has thus returned to its neutral position.

As far as the outer shape of the manual control valve 30 is concerned, it must be noted that it has a narrow, longish handle 104 and a broadened and raised head 106. The bottom plate 42 of the housing 30 is extended beyond the upper part of the housing. A suspension eye 108 is formed in this extension part. Excluding the suspension eye 108, the manual control unit 30 is approx. 100 mm to 110 mm long. The handle 104 is 30 mm wide. FIGS. 2 and 3 show the manual control unit 30 in its original size.

I claim:

1. Lifting apparatus (10) for insertion in a bathtub for handicapped persons, comprising: a bottom frame (13); a lift platform (16); a guide frame (14) connecting the lift platform (16) to the bottom frame (13); a hydraulic lifting device (12) with valve means (20) for activating the lifting device to raise and lower the lift platform by action of the guide frame on the bottom frame; the valve means (20) being located completely beneath the lift platform (16) and comprising at least two remotely operable working valves; a manual control unit (30) connected to the valve means (20) via at least three flexible hoses (36, 38); the manual control unit (30) comprising a first servo valve (34) and a second servo valve (34), the first and second servo valves being of substantially identical design and being manually operable; a common actuator (58) for selectively actuating said first and second servo valves; each of the servo valves (34) comprise a valve seat (86), means defining a control chamber (102) on one side of the valve set and a pressure chamber (80) on an opposite side of the valve seat, the control chamber (102) of the first servo valve (34) being connected to one of the flexible hoses (36, 38), the control chamber (102) of the second servo valve (34) being connected to a second one of the flexible hoses (36, 38), and the pressure chamber (80) of the first servo valve (34) and the pressure chamber (80) of the second servo valve (34) being commonly connected to a third one (38) of the flexible hoses; means for applying a restoring force to close each servo valve; a discharge line (40) for discharge from the manual control unit; each one of the servo valves (34) being biased into a closed position by the means for applying the restoring force, in which closed position the control chamber (102) is connected to the discharge line (40) and upon actuation of the actuator (58) against the restoring force, the one of the servo valve is moved into an open position, in which the control chamber (102) is sealed towards the discharge line (40) and connected to the pressure chamber (80).

2. Lifting apparatus as claimed in claim 1, wherein pivotably mounted on the lift platform (16), there is a back rest (18) with which an hydraulic swivelling means (19) engages, and the valve means (20) possesses at least four working valves and the manual control unit (30) possesses the same number of servo valves (34), and in each case one working valve is connected to a servo valve (34) by means of a separate control hose (36).

3. Lifting apparatus as claimed in claim 2, wherein the four servo valves (34) are arranged with parallel axes, and their axes intersect the corners of a square.

4. Lifting apparatus as claimed in claim 2, wherein all the servo valves (34) have a central, common manual operating element (70) with a plurality of switching positions (74).

5. Lifting apparatus as claimed in claim 4, wherein the actuator (58) of each servo valve (34) is biased in an initial position thereof by means of a spring (76), and the manual operating element (70), when not in operation, is kept in its central position by the actuators (58).

6. Lifting apparatus as claimed in claim 4, wherein the manual operating element (70) comprises a swivel lever protruding out of the manual control unit (30), said swivel lever being guided in a gate (74) having two guide slots crossing each other at right angles.

7. Lifting apparatus as claimed in claim 4, wherein the control unit (30) has a housing (32) with a spherical surface (68), the manual operating element (70) having a bearing part (66) in the shape of a universal ball joint, which is mounted on the spherical surface (68) of the housing (32), and is pivotable in at least two mutually perpendicular planes, and the bearing part (66) has at least four radial arms distributed about a circumference thereof, which overlap the actuators (58) of the servo valves (34).

8. Lifting apparatus as claimed in claim 4, wherein the control unit (30) has a housing (32) with a spherical surface (68), the manual operating unit (7) having a bearing part (66) in the shape of a universal ball joint, which is mounted on the spherical surface (68), the bearing part having a circumferential outer portion which overlaps the actuators (58) of the servo valves (34).

9. Lifting apparatus as claimed in claim 1, wherein each servo valve (34) is designed in such a way that its control chamber (102) is permanently connected either to the discharge line (40) or to the pressure chamber (80).

10. Lifting apparatus as claimed in claim 1, wherein each servo valve (34) has a spring-operated sealing body (82) that can rest against the valve seat (86), and which can be moved by the actuator (58), and, when the actuator (58) is moved out of an initial position, it seals off the control chamber (102) towards the discharge line (40).

11. Lifting apparatus as claimed in claim 10, wherein the actuator (58) has an axial hole facing the sealing body which communicates via a radial hole with the discharge line (40), and in the actuator (58), in its initial position, is spaced apart from the sealing body (82), with the axial hole of the actuator (58) terminating in the control chamber (102), and, when the servo valve (34) is operated, the actuator (58) comes to rest against the sealing body (82) during a first part of a stroke of the actuator, thus closing the axial hole, and causing the sealing body (82) to rise off the valve seat (86) during a remainder of the stroke.

* * * * *